United States Patent [19]

Bécus

[11] 4,271,896

[45] Jun. 9, 1981

[54] DEVICE FOR REGULATING THE FLOW THROUGH A PLUG OF A DISPENSING VESSEL IN A CONTINUOUS CASTING INSTALLATION, USING THE LEVEL OF THE METAL BATH IN THE RECEIVING INGOT MOLD

[75] Inventor: Robert Bécus, Ennery, France

[73] Assignee: Societe des Aciers Fins de l'Est, Hagondange, France

[21] Appl. No.: 51,648

[22] Filed: Jun. 25, 1979

[30] Foreign Application Priority Data

Jun. 28, 1978 [FR] France ..... 78 19391

[51] Int. Cl.[3] ..... B22D 11/10; B22D 11/16; B22D 39/00; B22D 41/10

[52] U.S. Cl. ..... 164/449; 164/4; 164/155; 164/337

[58] Field of Search ..... 164/4, 155, 449, 450, 164/156, 337; 222/602, 601

[56] References Cited

U.S. PATENT DOCUMENTS

| | | | |
|---|---|---|---|
| 1,207,251 | 12/1916 | Wettengel | 222/602 |
| 2,753,605 | 7/1956 | Carleton, Jr. | 164/155 |
| 2,753,606 | 7/1956 | Fogt | 222/602 |
| 2,832,110 | 4/1958 | Carleton, Jr. | 222/602 |
| 3,762,605 | 10/1973 | Seaton | 222/602 |
| 3,842,894 | 10/1974 | Southworth et al. | 164/449 X |
| 3,946,795 | 3/1976 | Bruderer et al. | 164/449 |

FOREIGN PATENT DOCUMENTS

| | | | |
|---|---|---|---|
| 44-24563 | 10/1969 | Japan | 222/602 |

*Primary Examiner*—R. L. Spruill
*Assistant Examiner*—Gus T. Hampilos
*Attorney, Agent, or Firm*—Owen, Wickersham & Erickson

[57] ABSTRACT

A device for regulating the flow through a plug of a dispensing vessel in a continuous casting installation, using the level of the metal bath in the receiving ingot mold, by means of a known electronic optical device. On each distributor there is a mechanical-reduction mechanism, with a purely mechanical proximity-control unit which is close to the casting unit and can be connected by a rapid coupling means to the mechanism. This control unit is actuated by a mechanical remote control from a remote-control console, which comprises both manual control and control by means of a servo-jack acting on the same mechanical transmission, while an emergency control is provided for acting directly on the proximity-control unit.

6 Claims, 1 Drawing Figure

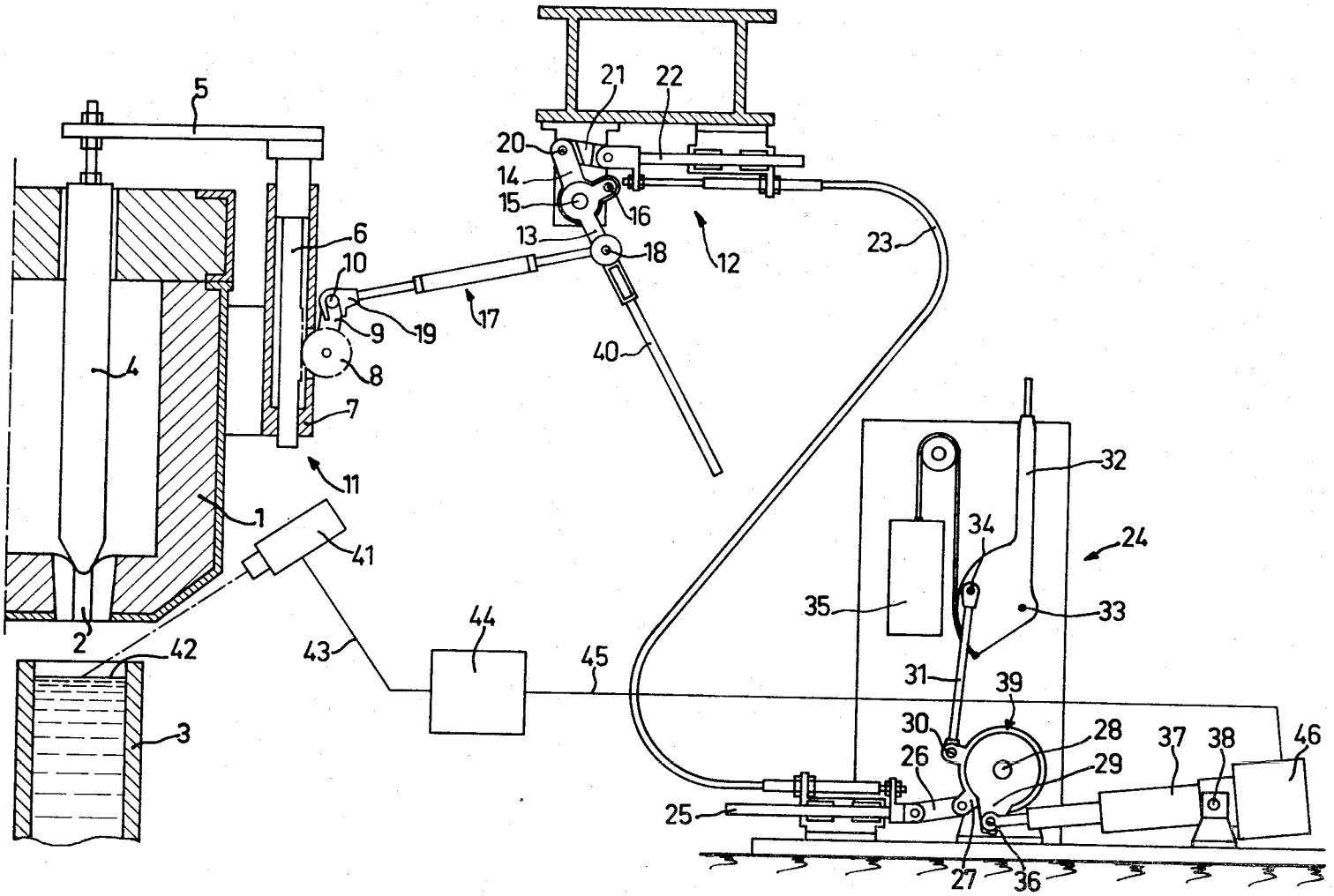
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46

DEVICE FOR REGULATING THE FLOW THROUGH A PLUG OF A DISPENSING VESSEL IN A CONTINUOUS CASTING INSTALLATION, USING THE LEVEL OF THE METAL BATH IN THE RECEIVING INGOT MOLD

BACKGROUND OF THE INVENTION

This invention relates to the regulation of the flow of molten metal, contained in a continuous casting distributor, which is itself fed by a casting ladle into the ingot molds where the metal solidifies.

It is already known to regulate such flow by means of refractory plug-nozzle elements. The plug, placed at the end of a tapping rod or bottstick, blocks the orifice of the nozzle to a greater or lesser extent by regulating the rising of the tapping rod or bottstick. The latter is raised by the action of a control which is fixed to the distributor and connected to the bottstick.

The action on the control can be manual, but it is also known to actuate the control by means of a device for measuring the level in the ingot mold. A closed regulating circuit of this kind can be produced by using suitably placed radioactive sources; however, these exhibit a number of disadvantages in use.

A closed-loop circuit, which is based on the sensing of the radiation emitted by the liquid metal in the ingot mold and has been tested industrially on a continuous casting installation of applicant's assignee together with the mechanical control forming the subject of this invention, overcomes these disadvantages and exhibits perfectly reliable operation and a remarkable stability of the level in the ingot mold. This result is obtained even in the case where pipes are used for protecting the stream of liquid metal flowing between the distributor and the ingot mold, together with synthetic slags for covering the meniscus of the liquid metal in the ingot mold.

Furthermore, it is known to design the distributor in such a way that it can be raised, lowered, moved sideways or tilted, in order to avoid the hazards of the casting process or to satisfy the necessary conditions at the beginning and end of this process, whether or not the casting is continuous. This requires easily detachable connections between the control parts attached to the distributor and those connected to the manual or automatic control components. It is necessary to reduce the intervention times to an absolute minimum and also to protect the delicate components of the automatic control; this is made possible by the invention.

It is also known that, in the case of automatic control, it is all the more difficult to start the casting process in the second case.

SUMMARY OF THE INVENTION

The present invention relates to a device for regulating the movement of the plug and bottstick system of a distributor in a continuous casting installation, in which the bottstick is connected via a cross-bar to a rod which can be vertically regulated in a guide fixed to the distributor. The vertical regulation is achieved by means of a rack-and-pinion device driven by a lever. This lever can be coupled rapidly by means of a fork-end connecting-rod forming part of a second purely mechanical unit which is remote-controlled, as via a reciprocating sheathed cable of a known type, from a control console possessing both manual control and control by means of an electro-mechanical servo-jack. The jack is actuated by the sensor by means of an electronic processing power amplifying unit of known type. Control by the jack is converted to manual control by means of an appropriate clutch arranged so as to permit the use of either one of the controls, as desired. The total running clearance is taken up by means of a counterweight for balancing the gravitational, hydrostatic and frictional forces, which is regulated on assembly so as to constantly maintain, regardless of the level in the distributor, a suitable force which is directed from bottom to top and always remains less than the weight of the tapping rod-plug unit. This counterweight avoids the use of elastic systems, the elastic properties of which vary with time in a high-temperature environment and which, moreover, produces forces which vary as a function of their deformation.

Further particular characteristics of the invention become apparent in the following description of an embodiment which is taken as an example and shown on the attached drawing.

BRIEF DESCRIPTION OF THE DRAWING

In the drawing:

The single FIGURE is a view of the overall device in elevation and in partial section.

DESCRIPTION OF A PREFERRED EMBODIMENT

The FIGURE shows a casting distributor 1 with its tap hole or orifice 2 intended for feeding an ingot mold 3, this orifice 2 being closed and opened by a bottstick 4, the upper end of which is linked by means of a cross-bar 5 to a rack 6 which slides in a support 7 integral with the structure of the ladle 1. A pinion 8 acts on this rack 6 and is fixed to the same shaft as a crank 9 having a pin 10.

Very near this casting unit 11, there is a proximity-control unit 12 which comprises a first lever 13 and a second lever 14 which are both articulated on the same fixed axle 15, it being possible for these two levers to be coupled to one another or uncoupled as desired, by positioning or withdrawing a spindle 16. One end of a control rod 17 of adjustable length is articulated at a point 18 on the lever 13, whereas its other end 19, in the form of a hook, can be attached to the pin 10 of the crank 9 of the above unit. The end 20 of the second lever 14 is linked by a small rod 21 to a sliding device 22 which is actuated by remote control, using a sheathed reciprocating cable 23 (like the cable of a camera cable-release mechanism), from a remote-control console 24 at which the other end of the sheathed reciprocating-control cable 23, is fixed to another sliding device 25. The device 25 is coupled via another small rod 26 to a third lever 27 which, together with a fourth lever 29, is articulated at a fixed point 28.

The third lever 27 can itself be actuated by a lateral articulation 30, and via a small rod 31, from a manual control lever 32 which pivots about a fixed axle 33 and comprises the articulation 34 of the other end of the small rod 31, simultaneously, a counterweight device 35 acts on this transmission as indicated above.

Furthermore, the end of an electric jack 37 actuated by an electric motor 46 is articulated at the end 36 of the fourth lever 29, the jack itself being articulated at a fixed point 38, and an electro magnetic clutch 39 makes it possible to couple the third lever 27 with the fourth lever 29 by action on a manual switch not shown.

An optical infra-red telescope 41, sensing the natural glow emitted from the level 42 of the molten metal in the mold 3, is used to transmit that level information by a line 43 to an electronic amplifier and feeding device 44, which feed by a feeding line 45 the electric motor 46 of the electric jack 37 in the direction which compensate the increase or decrease of the visible glowing area.

Finally, the device is advantageously completed by an emergency control consisting of an emergency control lever 40 which is fixed in the extension of the first lever 13.

After having positioned the distributor before casting, it suffices to hook the small adjustable rod 17 onto its pin 10. When the distributor has been filled with metal from the ladle, the casting operation can be started by acting manually on the control 32 which freely ensures the transmission of the movement, the clutch 39 not being actuated at this moment. It is then possible to ensure automatic regulation from the electronic-optical device 41–44 coupled to the motor 46 of the electric jack 37 as above mentioned, and at the same time actuating the switch of the electro-magnetic clutch 39 in clutching condition. This jack consequently controls the movement of the tapping rod 4, at the same time moving the lever 32.

As a result of the fact that the control console assembly 24 with its delicate parts, in particular the electric jack, the manual control and the balancing counterweight, are at a distance from the molten metal, the safety of the personnel is greater when the process is started and the equipment is also better preserved.

However, should the electronic device or the jack 37 break down, the clutch 39 is immediately disengaged and it is then possible to resume manual control by means of the lever 32. In the extreme case where even the remote control 23 or its levers or small transmission rods become blocked, the spindle 16 could then be withdrawn immediately and the casting operation could be continued by acting manually on the emergency control 40.

Finally, in the event of incidents requiring the emergency discharge of the distributor, the small rod 17 is uncoupled from the pin 10 and frees the distributor from any connection; this gives it complete freedom of movement, while ensuring that the nozzle is closed, the plug-tapping rod system blocking it under the action of its own weight.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. In a continuous casting installation comprising a ladle having wall portions defining a ladle orifice through which molten metal is poured into a continuous casting mold, a bottstick carrying a bottstick plug associated with said ladle orifice for controlling the flow of metal from said ladle and an electronic optical device for sensing the level of the metal in the mold, a device for controlling the position of said bottstick plug relative to said orifice in response to the level of metal in said mold, said device comprising:

mechanical reduction means connected to said bottstick for regulating the position of said bottstick plug relative to said ladle orifice;

a purely mechanical control means adjacent said ladle and associated with said mechanical reduction means for controlling said mechanical reduction means;

rapid coupling means connected to said purely mechanical control means for connecting said mechanical reduction means to said purely mechanical control means;

mechanical remote control transmission means connected to said purely mechanical control means for actuating said purely mechanical control means;

a remote control console means, comprising both a main manual control and a servo-jack control operating in response to level indications transmitted by said electronic optical device, said main manual control and said servo-jack control being operatively associated with said mechanical remote control transmission means for controlling said mechanical remote control transmission means, and emergency manual control means operatively associated with said purely mechanical control means for acting directly on said purely mechanical control means.

2. In a continuous casting installation comprising a ladle having wall portions defining a ladle orifice through which molten metal is poured into a continuous casting mold, a bottstick carrying a bottstick plug associated with said ladle orifice for controlling the flow of metal from said ladle and an electronic optical device for sensing the level of the metal in the mold, a device for controlling the position of said bottstick plug relative to said orifice in response to the level of metal in said mold, said device comprising:

mechanical reduction means comprising a rack connected to said bottstick for regulating the position of said bottstick plug relative to said ladle orifice, and a pinion in meshing engagement with said rack, said pinion being integral with a crank having a control pin;

a purely mechanical control means adjacent said ladle and associated with said mechanical reduction means for controlling said mechanical reduction means;

rapid coupling means comprising a rod of adjustable length, a first end of which is in the form of a hook removably connected to said control pin of said mechanical reduction means, and a second end of which is connected to said purely mechanical control means;

mechanical remote control transmission means connected to said purely mechanical control means for actuating said purely mechanical control means;

a remote control console means, comprising both a main manual control and a servo-jack control operating in response to level indications transmitted by said electronic optical device, said main manual control amd said servo-jack control being operatively associated with said mechanical remote control transmission means for controlling said mechanical remote control transmission means, and emergency manual control means operatively associated with said purely mechanical control means for acting directly on said purely mechanical control means.

3. In a continuous casting installation comprising a ladle having wall portions defining a ladle orifice through which molten metal is poured into a continuous casting mold, a bottstick carrying a bottstick plug associated with said ladle orifice for controlling the flow of metal from said ladle and an electronic optical device for sensing the level of the metal in the mold, a device for controlling the position of said bottstick plug relative to said orifice in response to the level of metal in said mold, said device comprising:

mechanical reduction means comprising a rack connected to said bottstick for regulating the position of said bottstick plug relative to said ladle orifice, and a pinion in meshing engagement with said rack, said pinion being integral with a crank having a control pin;

a purely mechanical control means adjacent said ladle and associated with said mechanical reduction means for controlling said mechanical reduction means, said control means comprising a first lever and a second lever both rotatably mounted on a common axle and coupled to one another by disconnected coupling means;

rapid coupling means comprising a rod of adjustable length, a first end of which is in the form of a hook removably connected to said control pin of said mechanical reduction means, and a second end of which is articulated to said first lever of said purely mechanical control means at a point spaced apart from said axle;

mechanical remote control transmission means connected to said second lever of said purely mechanical control means for actuating said purely mechanical control means;

a remote control console means, comprising both a main manual control and a servo-jack control operating in response to level indications transmitted by said electronic optical device, said main manual control and said servo-jack control being operatively associated with said mechanical remote control transmission means for controlling said mechanical remote control transmission means, and emergency manual control means operatively associated with said purely mechanical control means for acting directly on said purely mechanical control means.

4. In a continuous casting installation comprising a ladle having wall portions defining a ladle orifice through which molten metal is poured into a continuous casting mold, a bottstick carrying a bottstick plug associated with said ladle orifice for controlling the flow of metal from said ladle and an electronic optical device for sensing the level of the metal in the mold, a device for controlling the position of said bottstick plug relative to said orifice in response to the level of metal in said mold, said device comprising:

mechanical reduction means connected to said bottstick for regulating the position of said bottstick plug relative to said ladle orifice, and a pinion in meshing engagement with said rack, said pinion being integral with a crank having a control pin;

a purely mechanical control means adjacent said ladle and associated with said mechanical reduction means for controlling said mechanical reduction means, said control means comprising a first lever and a second lever both rotatably mounted on a common axle and coupled to one another by disconnected coupling means;

rapid coupling means comprising a rod of adjustable length, a first end of which is in the form of a hook removably connected to said control pin of said mechanical reduction means, and a second end of which is articulated to said first lever of said purely mechanical control means at a point spaced apart from said axle;

mechanical remote control transmission means connected to said second lever of said purely mechanical control means for actuating said purely mechanical control means;

a remote control console means, comprising both a main manual control and a servo-jack control operating in response to level indications transmitted by said electronic optical device, said main manual control and said servo-jack control being operatively associated with said mechanical remote control transmission means for controlling said mechanical remote control transmission means, and an emergency manual control lever forming an extension of said first lever beyond said point spaced apart from said axle, for manually acting directly on said purely mechanical control means.

5. In a continuous casting installation comprising a ladle having wall portions defining a ladle orifice through which molten metal is poured into a continuous casting mold, a bottstick carrying a bottstick plug associated with said ladle orifice for controlling the flow of metal from said ladle and an electronic optical device for sensing the level of the metal in the mold, a device for controlling the position of said bottstick plug relative to said orifice in response to the level of metal in said mold, said device comprising:

mechanical reduction means connected to said bottstick for regulating the position of said bottstick plug relative to said ladle orifice, and a pinion in meshing engagement with said rack, said pinion being integral with a crank having a control pin;

a purely mechanical control means adjacent said ladle and associated with said mechanical reduction means for controlling said mechanical reduction means, said control means comprising a first lever and a second lever both rotatably mounted on a common axle and coupled to one another by disconnected coupling means;

rapid coupling means comprising a rod of adjustable length, a first end of which is in the form of a hook removably connected to said control pin of said mechanical reduction means, and a second end of which is articulated to said first lever of said purely mechanical control means at a point spaced apart from said axle;

mechanical remote control transmission means connected to said second lever of said purely mechanical control means for actuating said purely mechanical control means;

a remote control console means, comprising both a main manual control and a servo-jack control operating in response to level indications transmitted by said electronic optical device, a third lever and a fourth lever both rotatably mounted on a common axis and releasably coupled one another by a clutch, said servo-jack control being operatively connected to said fourth lever, said main manual control being operatively connected to said third lever, and said third lever being operatively connected to said mechanical remote control transmission means for controlling said mechanical remote control transmission means, and an emergency manual control lever forming an extension of said first lever beyond said point spaced apart from said axle, for manually acting directly on said purely mechanical control means.

6. In a continuous casting installation comprising a ladle having wall portions defining a ladle orifice through which molten metal is poured into a continuous casting mold, a bottstick carrying a bottstick plug associated with said ladle orifice for controlling the flow of metal from said ladle and an electronic optical device for sensing the level of the metal in the mold, a device for controlling the position of said bottstick plug relative to said orifice in response to the level of metal in said mold, said device comprising:

mechanical reduction means connected to said bottstick for regulating the position of said bottstick plug relative to said ladle orifice, and a pinion in meshing engagement with said rack, said pinion being integral with a crank having a control pin;

a purely mechanical control means adjacent said ladle and associated with said mechanical reduction means for controlling said mechanical reduction means, said control means comprising a first lever and a second lever both rotatably mounted on a common axle and coupled to one another by disconnected coupling means;

rapid coupling means comprising a rod of adjustable length, a first end of which is in the form of a hook removably connected to said control pin of said mechanical reduction means, and a second end of which is articulated to said first lever of said purely mechanical control means at a point spaced apart from said axle;

mechanical remote control transmissiom means connected to said second lever of said purely mechanical control means for actuating said purely mechanical control means;

a remote control console means, comprising both a main manual control and an electric-jack control operating in response to level indications transmitted by said electronic optical device, a third lever and a fourth lever both rotatably mounted on a common axis and releasably coupled one another by an electro-magnetic clutch actuated together with said electric jack, said electric jack control being operatively connected to said fourth lever, said main manual control being operatively connected to said third lever, and said third lever being operatively connected to said mechanical remote control transmission means for controlling said mechanical remote control transmission means, and an emergency manual control lever forming an extension of said first lever beyond said point spaced apart from said axle, for manually acting directly on said purely mechanical control means.

* * * * *